United States Patent [19]

Ljung

[11] 4,000,735

[45] Jan. 4, 1977

[54] INSERT FOR THE FURNACES OF BOILERS

[76] Inventor: Sten Rune Ljung, Barnstensgatan 6,, 263 00 Hoganas, Sweden

[22] Filed: May 5, 1975

[21] Appl. No.: 574,281

[52] U.S. Cl. ..... 126/361; 126/390; 126/400; 431/171

[51] Int. Cl.[2] ..... F24H 1/34

[58] Field of Search ..... 126/400, 390, 350, 361; 431/171; 219/464

[56] References Cited

UNITED STATES PATENTS

| | | | |
|---|---|---|---|
| 2,516,738 | 7/1950 | Woolley | 126/400 X |
| 2,601,167 | 6/1952 | Navarro | 126/400 X |
| 2,858,781 | 11/1958 | Hexdall | 126/400 X |
| 2,903,550 | 9/1959 | Fritsche | 126/400 X |
| 3,536,059 | 10/1970 | Hearst | 126/400 X |
| 3,819,903 | 6/1974 | Frick | 219/464 |

*Primary Examiner*—William E. Wayner
*Assistant Examiner*—William E. Tapolcai, Jr.
*Attorney, Agent, or Firm*—Blair & Brown

[57] ABSTRACT

An insert for the furnaces of particularly oil-fired boilers for intermittent operation, comprising an assembly of elements of fire-resisting glass of slight material thickness relative to their total surface area. The assembly is placed such that heat is accumulated therein at the same time as the property of the glass to transmit flame radiation is exploited.

2 Claims, 2 Drawing Figures

INSERT FOR THE FURNACES OF BOILERS

The present invention relates to an insert for the furnaces of particularly oil-fired boilers.

It is known that boilers of the type used, for example, in detached houses have a relatively low efficiency, int.al. because of the fact that the radiation heat is utilized only to a limited degree. Attempts have been made to stack bricks in the furnace in order to improve its heat economy but in view of the fact that this amounts in principle to an additional walling-in of the furnace, no improvement could be achieved in this manner. Moreover, it is quite obvious that this will not result in a more effective utilization of the radiation heat.

The object of the present invention is to achieve the desired improvement of the heat economy of a boiler in an extremely simple manner. According to the invention the insert comprises an assembly of elements of fire-resisting glass of slight material thickness in relation to their total surface area, the assembly being located such that heat accumulation occurs during the intermittent operation of the burner at the same time as full use is made of the property of the glass to transmit the flame radiation.

Preferably, the greater part of the assembly of elements is placed above a horizontal plane through the burner flame.

An embodiment of the invention will be described in greater detail hereinbelow and with reference to the enclosed drawing on which:

Figure 1:
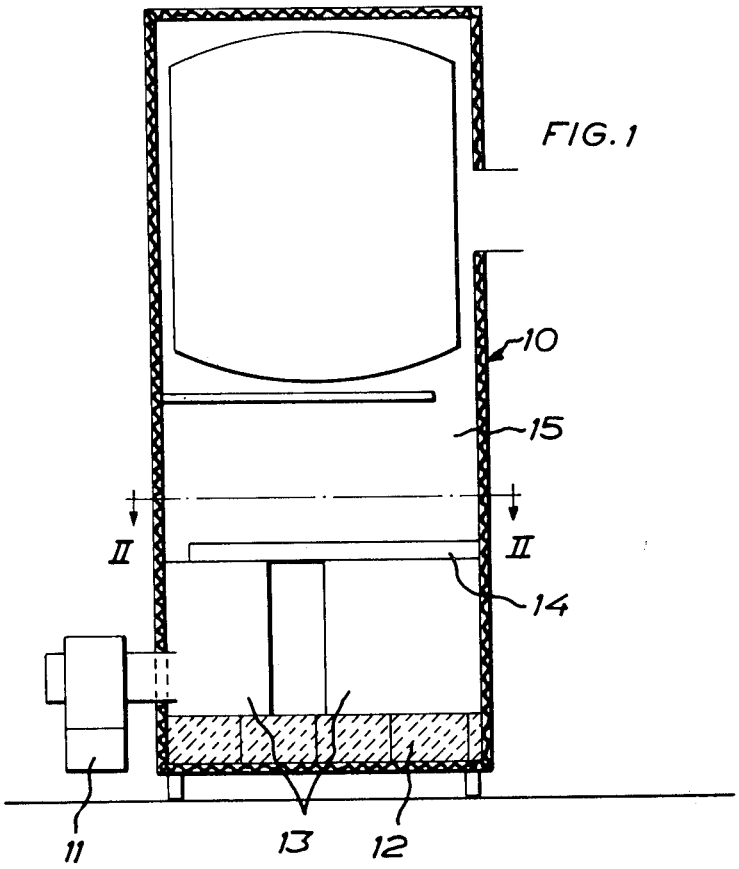
FIG. 1 is a longitudinal section of a boiler.
Figure 2:
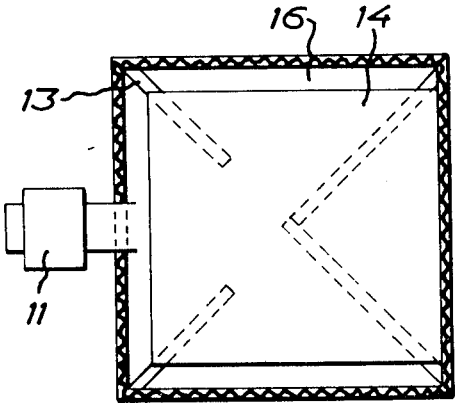
FIG. 2 is a section taken along the line II—II in FIG. 1.

In FIG. 1, a schematically suggested boiler 10 can be of any known type. The boiler 10 has a furnace 15 rectangular in cross-section and an oil burner 11 connected to the furnace. The bottom of the furnace is provided with a layer 12 of refractory brick. Four sheets of fire-resisting glass are placed on edge on the brick layer 12, that is to say, the planes of the sheets are vertical. The sheets each extend from one corner of the furnace and the planes of the sheets intersect at a point approximately in the centre of the furnace. In the illustrated embodiment, two glass sheets are disposed in V-shape, the apex of the V being directed towards the burner and the free ends of the stems of the V resting against the wall of the furnace located opposite the burner, each free end being adjacent one corner between the rear wall and the side walls of the furnace. The other two glass sheets 13 extend from the remaining two corners of the furnace but are smaller in width so that they terminate a distance from each other and from the apex of the V. A fifth sheet 14 of fire-resisting glass is placed on these glass sheets 13 which extend approximately diagonally in the furnace 15, the sheet 14 being, as is apparent from FIG. 2, of a size sufficient to cover the greater part of the cross-sectional area of the furnace. More precisely, the side of the glass sheet facing away from the burner 11 abuts against the wall of the furnace 15 located opposite the burner, while the remaining three edges of the sheet 14 are at a slight distance from the side walls of the furnace and the wall of the burner, respectively, so that a gap 16 is formed between the edges of the sheets and said walls. The thickness of the glass sheets 13 and 14 is approximately 15 mm. Normally, no fixed connection between the sheets 13 and the bottom of the furnace is required.

In order to investigate the heat accumulation effect of the insert, a conventional house boiler was first run without the insert, burning times of 9 min being measured, while the intervals between the burning times were 12.5 min long. After mounting of the glass insert shown on the drawing, the burning times amounted to 9.5 min while the length of the intervals between the burning times increased to 23–24 min under the same weather conditions and without altering any settings of the boiler. The National Swedish Institute for Materials Testing in Stockholm has also carried out extensive tests, according to which a fuel saving of 36% could be shown at the same time as the room temperature was increased by 1.3° C, using intermittently operating boilers.

It is obvious that the amount of glass and the shape, in particular the thickness, of the insert is of importance for achieving an advantageous result. In the tests carried out, the amount of glass was approximately 2.5 kg and the glass sheets were approximately 15 mm thick. It has hitherto been demonstrated that glass sheets of a thickness in excess of approximately 30 mm are less suited for this purpose, at the same time as the thickness should not be less than approximately 8 mm. In practice, glass sheets of the size shown on the drawing cannot be inserted in the furnace, for which reason the glass sheets 13 and 14 comprise plates or rods which are, for example, joined by "matching". The insert can also be produced at a very low price and be mounted by practically anybody.

It is indicated above that the insert is made of fire-resisting glass, it being understood, of course, that this term also includes transparent material having approximately the same properties, for example, quartz. Transparency is a requirement, since the major object of the insert is to utilize the radiation heat more effectively. There is no risk that soot be deposited on the glass, since the soot is burnt off. For this reason, the insert should be placed in association with the burner such that the radiation heat from the flame must, to a great extent, pass through the glass before it reaches the heat absorption surfaces in the boiler. As has been indicated above, it is also of importance that the material thickness be slight in relation to the total radiation heat absorption surface of the insert, so that the insert has time to become fully hot while the burner is in operation.

The insert defined in the main claim entails a highly unexpected effect (fuel saving and increasing temperature) and satisfies an individual and general desire; at least since the commencement of the oil crisis; that of saving fuel in a simple way.

What I claim and desire to secure by Letters Patent is:

1. In a boiler, particularly an oil-fired boiler, for intermittent operation, an intermittently fired oil burner, an insert placed in the furnace of said boiler, said insert comprising an assembly of elements of heat radiating fire-resisting glass of slight thickness in relation to their total surface area, said assembly being so located in association with the burner of said boiler that heat accumulation occurs at the same time as full use is made of the property of the glass to transmit the flame radiation.

2. An arrangement as claimed in claim 1, in which the greater part of the assembly of elements is placed above a horizontal plane through the burner flame.

* * * * *